US009617673B1

(12) United States Patent
Martelli

(10) Patent No.: US 9,617,673 B1
(45) Date of Patent: Apr. 11, 2017

(54) HOOK AND BOBBIN LOCATOR APPARATUS AND METHOD

(71) Applicant: John D. Martelli, Pensacola, FL (US)

(72) Inventor: John D. Martelli, Pensacola, FL (US)

( * ) Notice: Subject to any disclaimer, the term of this patent is extended or adjusted under 35 U.S.C. 154(b) by 110 days.

(21) Appl. No.: 14/678,936

(22) Filed: Apr. 4, 2015

(51) Int. Cl.

| | |
|---|---|
| ***D05B 19/00*** | (2006.01) |
| ***D05B 59/04*** | (2006.01) |
| ***D05B 57/26*** | (2006.01) |
| ***D05B 59/02*** | (2006.01) |
| ***D05B 69/28*** | (2006.01) |

(52) U.S. Cl.
CPC ..... *D05B 59/04* (2013.01); *D05B 57/26* (2013.01); *D05B 59/02* (2013.01); *D05B 69/28* (2013.01); *D05D 2207/04* (2013.01)

(58) Field of Classification Search
CPC ..... D05B 59/04; D05B 57/14; D05B 57/00; D05B 73/12; D05D 2207/04
USPC ..... 2/180, 181, 185, 189, 470.05, 475.01, 2/232; 112/180, 181, 185, 189, 470.05, 112/475.01, 232
See application file for complete search history.

(56) References Cited

U.S. PATENT DOCUMENTS

| | | | | |
|---|---|---|---|---|
| 2,298,871 A * | 10/1942 | Cumfer | D05B 59/04 | 112/186 |
| 5,617,743 A * | 4/1997 | Rednour | D04B 9/44 | 66/9 A |
| 5,718,181 A * | 2/1998 | Shinozuka et al. | D05B 59/04 | 112/180 |
| 5,775,243 A * | 7/1998 | Kinoshita | D05B 59/04 | 112/186 |
| 6,041,725 A * | 3/2000 | Resta | D05B 59/04 | 112/180 |
| 6,286,444 B1 * | 9/2001 | Swaney | D05B 59/04 | 112/117 |

* cited by examiner

*Primary Examiner* — Tejash Patel
(74) *Attorney, Agent, or Firm* — J. Nevin Shaffer, Jr.

(57) ABSTRACT

A hook and bobbin locator apparatus and method consisting of a mounting plate and more than one hook and bobbin combination. Each of the more than one hook and bobbin combinations is connected with a stepper motor and each of the more than one hook and bobbin combinations are removably connected with the mounting plate. A stepper motor is also connected with the mounting plate and a controller is connected with the mounting plate stepper motor and the hook and bobbin combination stepper motors such that movement of the mounting plate and the hook and bobbin combinations are controlled by the controller.

20 Claims, 4 Drawing Sheets

HOOK AND BOBBIN LOCATOR APPARATUS AND METHOD

FIELD OF THE INVENTION

This invention relates to a hook and bobbin locator device. In particular, in accordance with one embodiment, the invention relates to a hook and bobbin locator apparatus consisting of a mounting plate and more than one hook and bobbin combination. Each of the more than one hook and bobbin combinations is connected with a stepper motor and each of the more than one hook and bobbin combinations are removably connected with the mounting plate. A stepper motor is also connected with the mounting plate and a controller is connected with the mounting plate stepper motor and the hook and bobbin combination stepper motors such that movement of the mounting plate and the hook and bobbin combinations are controlled by the controller.

BACKGROUND OF THE INVENTION

A problem exists with regard to the use of machines using bobbins containing thread. The problem is that bobbins contain only a limited amount of thread. Once empty the practice is to stop and replace the empty bobbin with a full bobbin. In particular, by way of example only and not by way of limitation, the process of creating quilts by use of sewing machines typically requires the use of twelve to twenty-five bobbins full of thread. This is a problem because, again, when a bobbin runs out of thread, the process must be stopped and the empty bobbin removed and replaced with a new bobbin with thread. This is a time consuming and tedious, repetitive process that, in aggregate, adds considerable wasted time.

Further, a problem exists in that the absence of thread in the bobbin is not readily observable in prior art systems. This results in the advancement of the material for some distance after thread has run out. This creates a tremendously difficult problem of trying to locate the place where the bobbin thread ran out after replacing the empty bobbin with a full bobbin. The best that can be done now is to "eyeball" the location which is thus dependent on operator skill and precision. Even the most skilled operator is not always entirely accurate and thus it is currently the state of the art to simply accept the fact that misplaced stitching is something simply to be accepted as a "minor" annoyance.

Still further, the prior art systems using bobbins continuously turns the bobbin when connected with the system. This causes wear and tear on the bobbin and requires them to be replaced frequently and at some added expense.

Thus, there is a need in the art for an apparatus and method for quickly and easily replacing bobbins that are empty with bobbins with thread. There is a further need for a system that ensures that once a bobbin with thread is in position, that the position is located precisely at the point the last bobbin ran out of thread. Still further there is a need in the art for a system that controllably operates bobbins only as and when needed.

It therefore is an object of this invention to provide a hook and bobbin locator apparatus and method that provides a source of many bobbins filled with thread that is quickly and easily maneuverable to move a bobbin with thread to the position of a bobbin without thread and to ensure that thread is started at the precise location that thread ran out. A further object of the invention is to enable controlled operation of a bobbin when and as needed.

SUMMARY OF THE INVENTION

Accordingly, the hook and bobbin locator apparatus of the present invention, according to one embodiment, includes a mounting plate and more than one hook and bobbin combination. Each of the more than one hook and bobbin combinations is connected with a stepper motor and each of the more than one hook and bobbin combinations are removably connected with the mounting plate. A stepper motor is also connected with the mounting plate and a controller is connected with the mounting plate stepper motor and the hook and bobbin combination stepper motors such that movement of the mounting plate and the hook and bobbin combinations are controlled by the controller.

All terms used herein are given their common meaning so that "hook and bobbin combination" identifies and describes combinations of hooks and bobbins now known or hereafter developed for containing thread and delivering thread from the bobbin to the hook, for example only. Likewise, "stepper motor" identifies a motor that divides a full rotation into a number of equal steps, as now known or hereafter developed and not described more fully hereafter. Further, "controller" identifies a device or group of devices designed to govern in some predetermined manner the performance of a motor. A motor "controller" may include manual or automatic means for starting and stopping a motor, such as a stepper motor, for selecting forward or reverse rotation, selecting and regulating the speed, regulating or limiting the torque and protecting against overloads and faults for example only and not by way of limitation.

According to another aspect of the invention, an encoder is connected with the hook and bobbin combination stepper motors and the mounting plate stepper motor.

As used herein, the term "encoder" is used to describe a device, as known, that maintains position information with regard to the object to which it is attached when power is removed from the system and is not described more fully hereafter.

In another aspect, a shaft is connected with the mounting plate and another shaft is connected with the mounting plate stepper motor. Timing gears are connected to both the mounting plate shaft and the mounting plate stepper motor shaft and a timing belt is connected with the timing gears.

In one aspect, thread is provided in the more than one hook and bobbin combinations and a thread break detector is provided for detection of the absence of thread in a hook and bobbin combination. As used herein, the term "absence of thread" is used to identify a situation where no thread is present or movement of thread past the thread break detector stops such that while some thread may be present at the thread break detector the lack of movement indicates an absence of thread due to an empty bobbin or break. A "thread break detector" may include an electronic eye or motion detector or a combination of that or other devices now known or hereafter developed and not described more fully hereafter.

According to another aspect, the thread break detector is connected with the controller. In a further aspect, the detection of absence of thread in one of the hook and bobbin combinations that is empty is sent to the controller such that the controller stops movement of the empty hook and bobbin combination. In another aspect, thereafter the controller operates the mounting plate to move such that the empty hook and bobbin combination position is moved and replaced by a hook and bobbin combination with thread. In another aspect, the controller then activates one of the hook and bobbin combinations with thread after movement of the mounting plate such that the full hook and bobbin combination is located in the position the empty hook and bobbin combination maintained before it was moved and uses the encoders such that thread is started at the exact location where the empty hook and bobbin combination became empty of thread.

In one aspect, the mounting plate is a circular shaped disc with a top and a bottom and the more than one hook and bobbin combinations are connected in spaced apart relation to the top of the mounting plate.

In another aspect, the more than one hook and bobbin combinations consist of a first section with top and a bottom, and a second section, with a bobbin in a bobbin case located within a surrounding hook at the top of the first section and where the second section includes the stepper motor connected at the bottom of the first section and an encoder connected with the stepper motor.

According to another embodiment, in a sewing machine, a hook and bobbin locator apparatus consists of a mounting plate connected to the sewing machine. More than one hook and bobbin combinations are provided, where each of the more than one hook and bobbin combinations is connected with a stepper motor and where each of the more than one hook and bobbin combinations is removably connected with the mounting plate and, further, where thread is included in bobbins in each of the hook and bobbin combinations. A stepper motor is connected with the mounting plate, a drive motor is connected with the sewing machine and an encoder is connected with the hook and bobbin combination stepper motors, the mounting plate stepper motor and the drive motor. A controller is connected with the drive motor, the mounting plate stepper motor and the hook and bobbin combination stepper motors such that movement of the mounting plate and the hook and bobbin combinations are controlled by the controller. A thread break detector is connected with the controller for detection of the absence of thread in a hook and bobbin combination.

As used herein the term "sewing machine" describes a powered device for manipulating a needle and thread or threads to join material together or to add thread in the nature of design stitching to material, such as is common in the creation of quilts, for example only and not by limitation.

According to another aspect of this invention, a shaft is connected with the mounting plate and another shaft is connected with the mounting plate stepper motor. Timing gears are connected to both the mounting plate shaft and the mounting plate stepper motor shaft and a timing belt is connected with the timing gears.

In one aspect, the detection by the thread break detector of absence of thread in one of the hook and bobbin combinations that is empty is sent to the controller such that the controller stops movement of the empty hook and bobbin combination. In another aspect, after the detection of absence of thread is sent to the controller, the controller operates the mounting plate to move such that the empty hook and bobbin combination position is moved and replaced by a hook and bobbin combination with thread. In another aspect, the controller utilizes the encoders and activates one of the hook and bobbin combinations with thread after movement of the mounting plate such that thread is started at the exact location where the empty hook and bobbin combination became empty of thread.

In another aspect, the mounting plate is a circular shaped disc with a top and a bottom and the more than one hook and bobbin combinations are connected in spaced apart relation to the top of the mounting plate.

In a further aspect, the more than one hook and bobbin combinations consist of a first section with top and a bottom, and a second section, with a bobbin in a bobbin case located within a surrounding hook at the top of the first section and the second section includes the stepper motor connected at the bottom of the first section and an encoder connected with the stepper motor.

According to another embodiment, a hook locator method consists of:

a. providing a mounting plate and more than one hook and bobbin combinations, where each of the more than one hook and bobbin combinations is connected with a stepper motor, and where the more than one hook and bobbin combinations are removably connected with the mounting plate; a stepper motor connected with the mounting plate; and a controller connected with the mounting plate stepper motor and the hook and bobbin combination stepper motors such that movement of the mounting plate and the hook and bobbin combinations are controlled by the controller; and b. operating the controller so as to move the hook mounting plate to reposition the more than one hook bobbin combinations.

In one aspect, this invention further includes an encoder connected with the hook and bobbin combination stepper motors and the hook mounting plate stepper motor.

In a further aspect, the invention includes thread in the more than one hook and bobbin combinations and a thread break detector connected with the controller for detection of the absence of thread in a hook and bobbin combination.

DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE INVENTION

Figure 1:
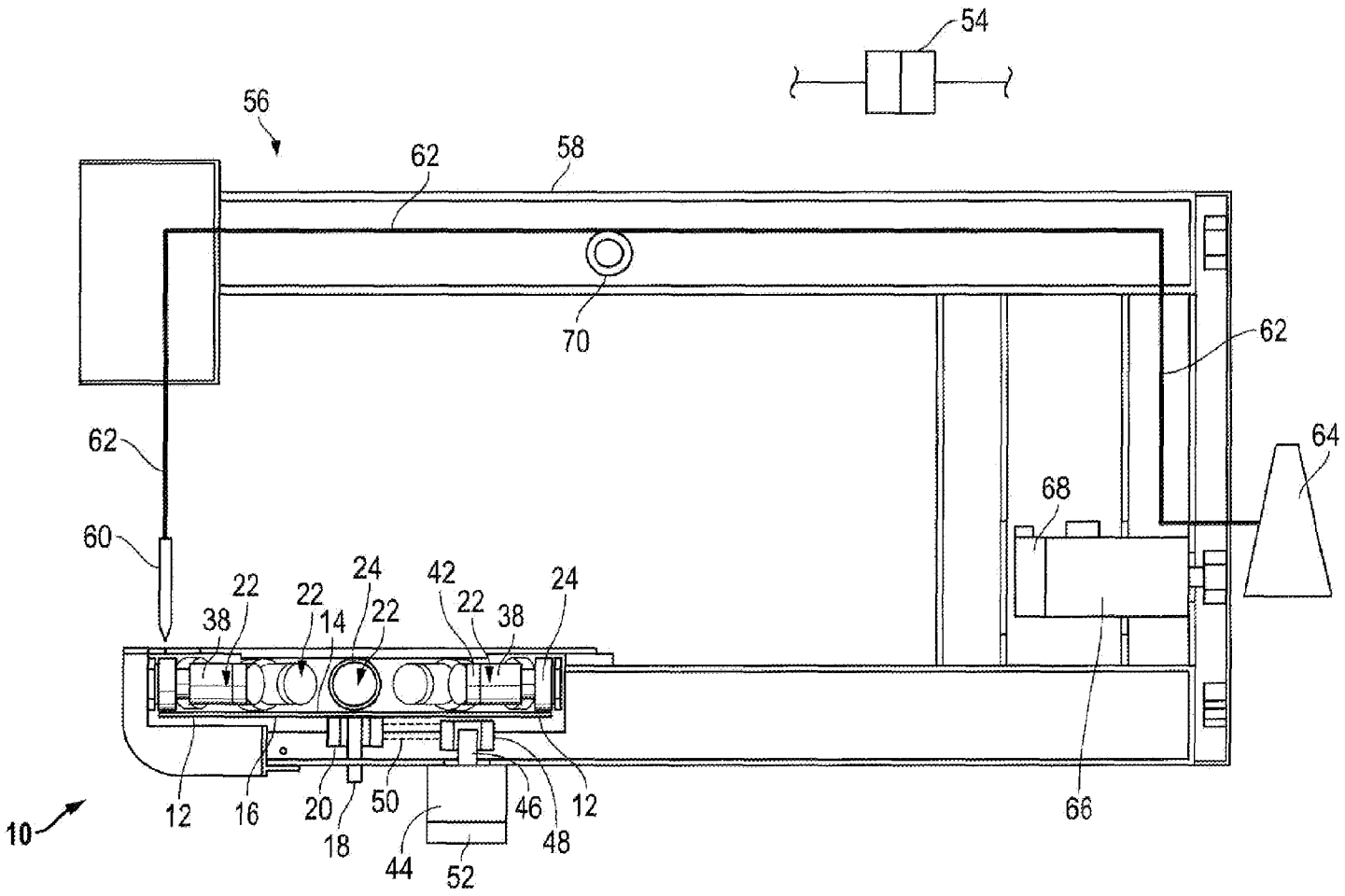
FIG. 1 is a side partial cut away view of the hook and bobbin locator according to one embodiment.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the invention be regarded as including equivalent constructions to those described herein insofar as they do not depart from the spirit and scope of the present invention.

For example, the specific sequence of the described process may be altered so that certain processes are conducted in parallel or independent, with other processes, to the extent that the processes are not dependent upon each other. Thus, the specific order of steps described herein is not to be considered implying a specific sequence of steps to perform the process. In alternative embodiments, one or more process steps may be implemented by a user assisted process and/or manually. Other alterations or modifications of the above processes are also contemplated. For example, further insubstantial approximations of the process and/or algorithms are also considered within the scope of the processes described herein.

In addition, features illustrated or described as part of one embodiment can be used on other embodiments to yield a still further embodiment. Additionally, certain features may be interchanged with similar devices or features not mentioned yet which perform the same or similar functions. It is therefore intended that such modifications and variations are included within the totality of the present invention.

It should also be noted that a plurality of hardware and software based devices, as well as a plurality of different structural components, may be utilized to implement the invention. Furthermore, and as described in subsequent paragraphs, the specific configurations illustrated in the drawings are intended to exemplify embodiments of the invention and that other alternative configurations are possible.

A preferred embodiment of the present invention is illustrated by way of example in FIGS. 1-4. With specific reference to FIGS. 1 and 2, hook and bobbin locator 10 includes a mounting plate 12. In one embodiment, mounting plate 12 is circular in shape with a top 14 and a bottom 16. A shaft 18 is connected with the mounting plate 12, as at the bottom 16 for example, and a timing gear 20 is connected with shaft 18, for use in movement of the mounting plate as will be described more fully hereafter.

Hook and bobbin combination 22 includes a hook 24 and a bobbin 26 (not shown but see FIG. 4) in a bobbin case 28. Preferably, bobbin 26 and bobbin case 18 are located within hook 24 as is shown in the figures. Multiple numbers of hook and bobbin combinations 22 are connected in equally spaced apart relation to each other to the mounting plate 12, as on the top 14 of mounting plate 12 as shown. When ready for use, hook and bobbin combination 22 includes thread 30 on bobbin 26 located within bobbin case 28 within hook 24 as more clearly shown in FIG. 4.

Figure 4:
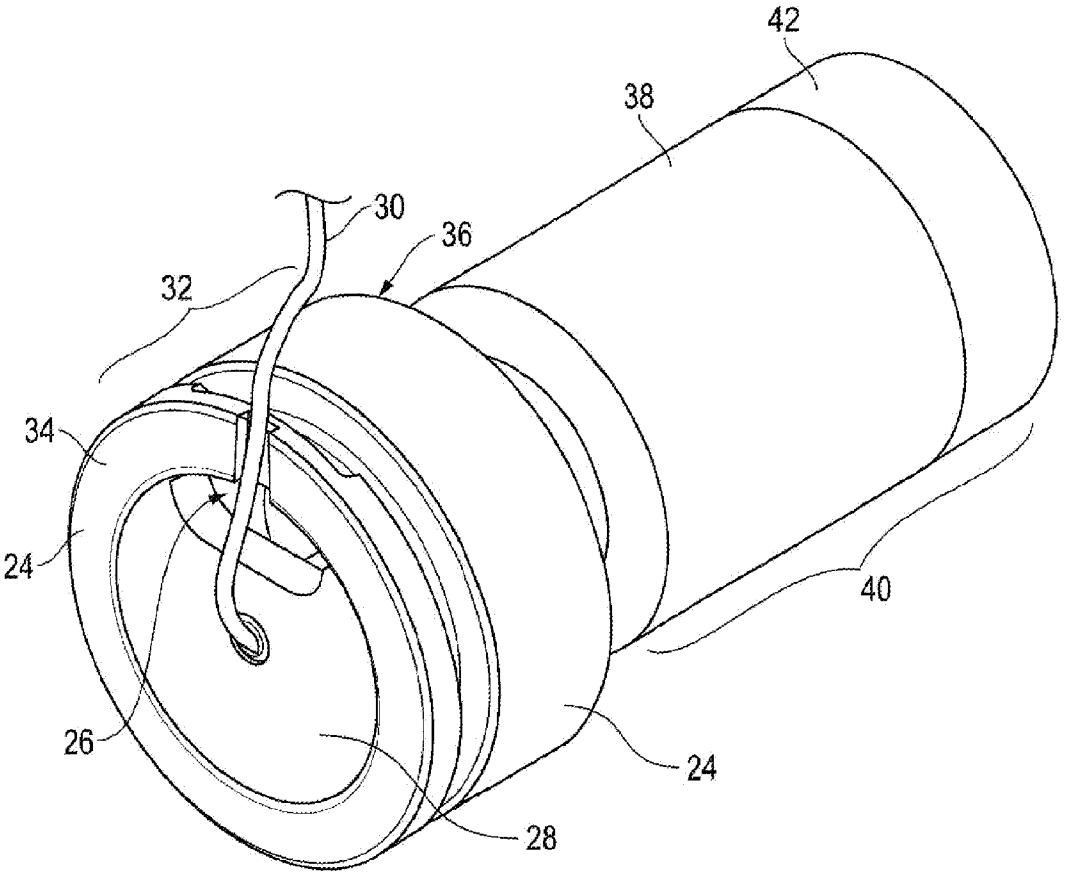
FIG. 4 is an isolated view of a hook and bobbin combination.

Hook and bobbin combination 22 forms a first section 32 with a top 34 and a bottom 36 (see FIG. 4). Stepper motor 38 is connected with the hook and bobbin combination 22 as at the bottom 36 of first section 32 and stepper motor 38 creates a second section 40 of hook and bobbin combination 22. Preferably an encoder 42 is connected with stepper motor 38, all again as more clearly shown in FIG. 4.

Referring to FIG. 1, stepper motor 44 includes a shaft 46 and, preferably, shaft 46 includes timing gear 48. A timing belt 50 connects timing gear 48 on stepper motor 44 shaft 46 with the timing gear 20 on the shaft 18 of mounting plate 12. Encoder 52 is connected with stepper motor 44.

Figure 2:
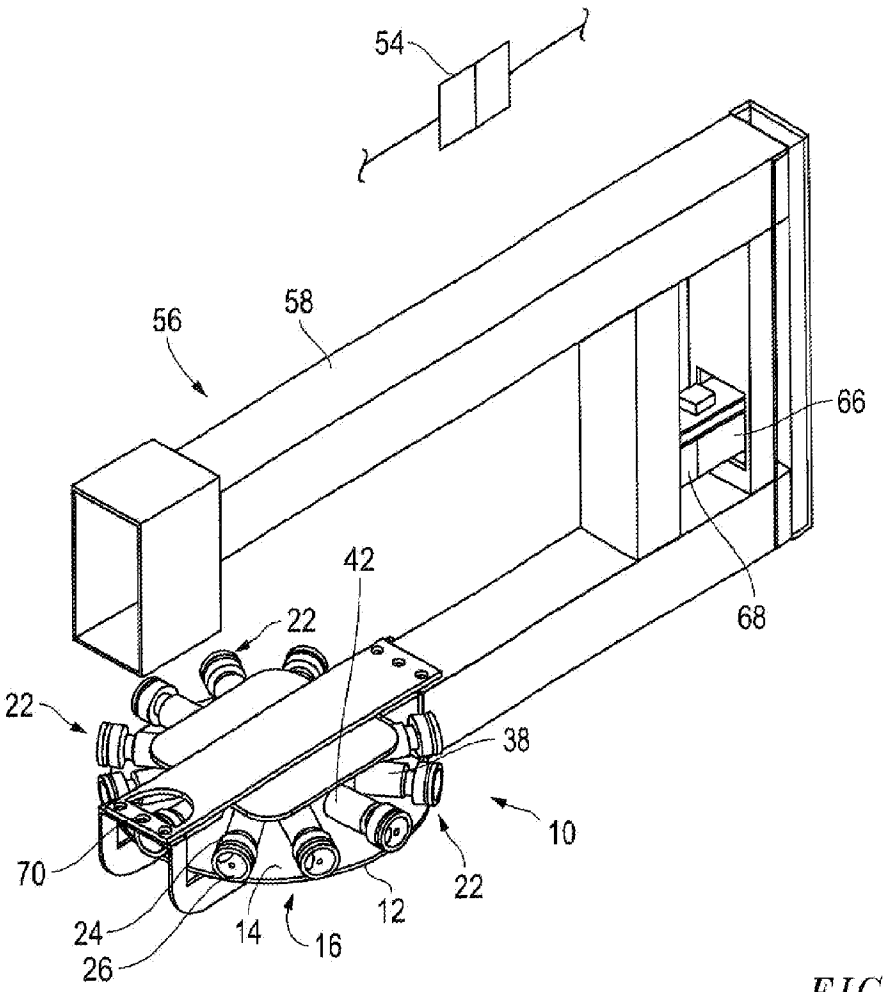
FIG. 2 is a perspective partial cut away view of the invention of FIG. 1.
Figure 3:
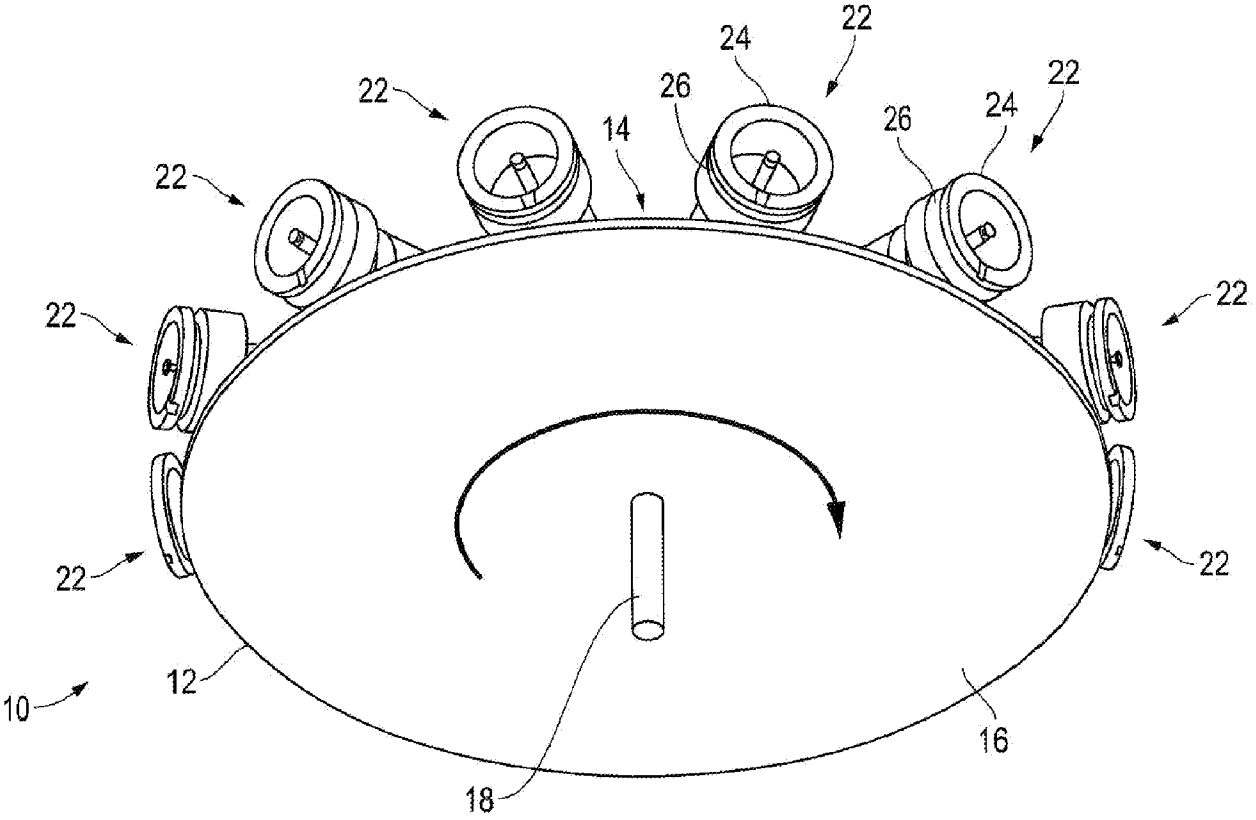
FIG. 3 is an isolated perspective view of the mounting plate with attached hook and bobbin combination.

Still referring to FIGS. 1 and 2, controller 54 is illustrated and is connected with stepper motor 38 and encoder 42 as well as stepper motor 44 and encoder 52 for the control and operation of each of those devices. The controller 54 may be connected by hard wire or remotely or in some combination thereof.

These figures also illustrate sewing machine 56 with an arm 58 that extends over mounting plate 12 and includes a needle 60 bringing thread 62 from thread spool 64 to interact with one of the hook and bobbin combinations 22 as is known in the art. Drive motor 66 is shown connected with sewing machine 56 for operation of the sewing machine 56, again as is known in the art and not described more fully hereafter. Encoder 68 is connected with drive motor 66 and both encoder 68 and drive motor 66 are connected with controller 54. Controller 54 operates as described above to control the operation of drive motor 66 and encoder 68.

Also illustrated is thread break detector 70. Thread break detector 70 may be located in arm 58 of sewing machine 56 such that when a bobbin 26 runs out of thread 30, needle 60 stops advancing thread 62 and this lack of motion of thread 62 indicates and absence of thread in bobbin 26. Thread break detector 70 may also be positioned at the hook bobbin combination 22 that is actively providing thread 30 from its position underneath needle 60 so as to detect the absence of thread 30 directly. Wherever it is located, thread break detector 70 is connected with controller 54 such that upon notice from the thread break detector 70, controller 54 operates to stop the empty hook and bobbin combination 22. Then controller 54 activates stepper motor 44 to turn shaft 46 that moves timing belt 50 that engages timing gear 20 that turns mounting plate 12 so as to position a hook and bobbin combination 22 in the position vacated by the empty hook and bobbin combination 22 beneath needle 60. Encoders 42 and 52 on hook and bobbin combinations 22 and stepper motor 44 provide the exact location of where thread 30 stopped such that thread 30 can be started at that precise location. When sewing machine 56 including drive motor 66 and encoder 68 are connected with controller 54 this same process is accomplished in conjunction with the use of thread 62 from thread spool 64, for example.

The description of the present embodiments of the invention has been presented for purposes of illustration, but is not intended to be exhaustive or to limit the invention to the form disclosed. Many modifications and variations will be apparent to those of ordinary skill in the art. As such, while the present invention has been disclosed in connection with an embodiment thereof, it should be understood that other embodiments may fall within the spirit and scope of the invention as defined by the following claims.

What is claimed is:

1. A hook and bobbin locator apparatus comprising:

a. a mounting plate;

b. more than one hook and bobbin combination, wherein each of said more than one hook and bobbin combinations is connected with a hook and bobbin combination stepper motor, and wherein said more than one hook and bobbin combinations are removably connected with said mounting plate;

c. a mounting plate stepper motor connected with the mounting plate; and d. a controller connected with the mounting plate stepper motor and the hook and bobbin combination stepper motors such that independent movement of the mounting plate and the hook and bobbin combinations are controlled by said controller.

2. The apparatus of claim 1 further including an encoder connected with said hook and bobbin combination stepper motors and said mounting plate stepper motor.

3. The apparatus of claim 1 further including:

a. a shaft connected with said mounting plate;

b. a shaft connected with said mounting plate stepper motor;

c. timing gears connected to both the mounting plate shaft and the mounting plate stepper motor shaft; and d. a timing belt connected with the timing gears.

4. The apparatus of claim 1 further including:

a. thread in the more than one hook and bobbin combinations; and b. a thread break detector for detection of the absence of thread in a hook and bobbin combination.

5. The apparatus of claim 4 wherein said thread break detector is connected with said controller.

6. The apparatus of claim 5 wherein detection of absence of thread in one of said hook and bobbin combinations that is empty is sent to said controller such that said controller stops movement of the empty hook and bobbin combination.

7. The apparatus of claim 6 wherein detection of absence of thread is sent to said controller such that said controller operates the mounting plate to move such that the empty hook and bobbin combination position is moved and replaced by a hook and bobbin combination with thread.

8. The apparatus of claim 7 wherein said controller utilizes the encoders and activates one of said hook and bobbin combinations with thread after movement of said mounting plate at the exact location where the empty hook and bobbin combination became empty of thread.

9. The apparatus of claim 1 wherein the mounting plate is a circular shaped disc with a top and a bottom and said more than one hook and bobbin combinations are connected in spaced apart relation to the top of said mounting plate.

10. The apparatus of claim 1 wherein the more than one hook and bobbin combinations consist of a first section with top and a bottom, and a second section, with a bobbin in a bobbin case located within a surrounding hook at the top of the first section and wherein said second section includes the stepper motor connected at the bottom of the first section and an encoder connected with said stepper motor.

11. In a sewing machine, a hook and bobbin locator apparatus comprising:

a. a mounting plate connected to said sewing machine;

b. more than one hook and bobbin combinations, wherein each of said more than one hook and bobbin combinations is connected with a hook and bobbin combination stepper motor, and wherein each of said more than one hook and bobbin combinations is removably connected with said mounting plate and wherein thread is included in bobbins in each of said hook and bobbin combinations;

c. a mounting plate stepper motor connected with the mounting plate;

d. a drive motor connected with said sewing machine;

e. an encoder connected with said hook and bobbin combination stepper motors, said mounting plate stepper motor and said drive motor, f. a controller connected with the drive motor, the mounting plate stepper motor and the hook and bobbin combination stepper motors such that independent movement of the mounting plate and the hook and bobbin combinations are controlled by said controller, and g. a thread break detector connected with said controller for detection of the absence of thread in a hook and bobbin combination.

12. The apparatus of claim 11 further including:

a. a shaft connected with said mounting plate;

b. a shaft connected with said mounting plate stepper motor, c. timing gears connected to both the mounting plate shaft and the mounting plate stepper motor shaft; and d. a timing belt connected with the timing gears.

13. The apparatus of claim 11 wherein detection by said thread break detector of absence of thread in one of said hook and bobbin combinations that is empty is sent to said controller such that said controller stops movement of the empty hook and bobbin combination.

14. The apparatus of claim 13 wherein detection of absence of thread is sent to said controller such that said controller operates the mounting plate to move such that the empty hook and bobbin combination position is moved and replaced by a hook and bobbin combination with thread.

15. The apparatus of claim 14 wherein said controller activates one of said hook and bobbin combinations with thread after movement of said mounting plate at the exact location where the empty hook and bobbin combination became empty of thread.

16. The apparatus of claim 11 wherein the mounting plate is a circular shaped disc with a top and a bottom and said more than one hook and bobbin combinations are connected in spaced apart relation to the top of said mounting plate.

17. The apparatus of claim 11 wherein the more than one hook and bobbin combinations consist of a first section with top and a bottom, and a second section, with a bobbin in a bobbin case located within a surrounding hook at the top of the first section and wherein said second section includes the stepper motor connected at the bottom of the first section and an encoder connected with said stepper motor.

18. A hook locator method comprising:

a. providing a mounting plate and more than one hook and bobbin combinations, wherein each of said more than one hook and bobbin combinations is connected with a hook and bobbin combination stepper motor, and wherein said more than one hook and bobbin combinations are removably connected with said mounting plate; a mounting plate stepper motor connected with the mounting plate; and a controller connected with the mounting plate stepper motor and the hook and bobbin combination stepper motors such that independent movement of the mounting plate and the hook and bobbin combinations are controlled by said controller; and b. operating the controller so as to move the hook mounting plate to reposition the more than one hook bobbin combinations.

19. The method of claim 18 further including an encoder connected with said hook and bobbin combination stepper motors and said hook mounting plate stepper motor.

20. The method of claim 18 further including:

a. thread in the more than one hook and bobbin combinations; and b. a thread break detector connected with said controller for detection of the absence of thread in a hook and bobbin combination.

* * * * *